United States Patent [19]

Schäufele et al.

[11] 4,054,196

[45] Oct. 18, 1977

[54] APPARATUS FOR RECEIVING AND STORING EMPTY BOTTLES

[75] Inventors: Eugen Schäufele, Henstedt-Ulzburg; Hans Herman Trautwein, Stuttgart, both of Germany

[73] Assignee: The Firm of Eugen Schäufele, Ostfildern, Germany

[21] Appl. No.: 654,606

[22] Filed: Feb. 2, 1976

[30] Foreign Application Priority Data

Feb. 3, 1975 Germany ..... 2504352

[51] Int. Cl.[2] ..... G07F 7/06

[52] U.S. Cl. ..... 194/4 C

[58] Field of Search ..... 194/4 R, 4 B, 4 C, 4 D, 194/4 E, 4 F, 4 G; 198/DIG. 8, 211, 25, 347

[56] References Cited

U.S. PATENT DOCUMENTS 2,992,717 7/1961 Putman, Sr. ..... 194/4 R 3,412,837 11/1968 Myers ..... 194/4 R 3,545,169 12/1970 Nash ..... 198/25 X

*Primary Examiner*—Stanley H. Tollberg

*Attorney, Agent, or Firm*—Edwin E. Greigg

[57] ABSTRACT

An apparatus for automatically receiving empty bottles and storing them in an internal container includes a mechanism which discriminates against improperly sized bottles and also returns the monetary deposit which may have been made at the time of purchase of the full bottle.

The apparatus includes a bottle conveyor mechanism which accepts bottles in a horizontal position on sprocket discs and, after suitable actuation of door-locking and dimension-checking switches, rotates the discs and transports the bottle upwardly. The positive insertion of the transported bottle into the bottle storage container above causes a realignment of the bottles already stored there. The stored bottles align themselves in parallel layers until a limit switch prevents further operation when the container is filled up.

14 Claims, 6 Drawing Figures

APPARATUS FOR RECEIVING AND STORING EMPTY BOTTLES

BACKGROUND OF THE INVENTION

The invention relates to an apparatus for receiving and stacking substantially cylindrical objects, especially empty soft-drink bottles, in an appropriate storage container.

Many attempts have been made to design devices which collect empty bottles of a particular size and shape in a container. An additional task of these devices is to make an automatic refund of the bottle deposit made at the time of purchase.

In one such device, described in DT OS 1 947 729, the front of the device has several openings which correspond to the permitted contours of the bottle. Each of these recesses or openings is provided with several pairs of electrical sensor contacts for actuating a coin return mechanism and these contact pairs test the dimensions of the bottle in various places and then actuate the coin return mechanism. The bottles then slide down a ramp into a collecting container. Aside from the difficult insertion of bottles of different size and the expensive and complicated testing mechanism, involving a large number of sensing switches, there is, furthermore, a distinct danger of breaking individual bottles when they impinge on the collection container and, furthermore, the bottles are deposited in a completely random and mixed-up manner. For this reason, the container can hold only relatively few bottles and, in addition, any remaining fluid in the bottles will run out and contaminate the apparatus.

In another device, according to DT OS 1 574 575, the bottles are inserted at the top of the device and fall freely into a container whose bottom is intended to be lowered according to the weight of the bottles in the container. Here, too, there is a distinct possibility of a destruction of the bottles after their free fall which cannot be entirely eliminated and, again, the bottles come to rest in a random and disorderly manner. Furthermore, remaining fluid in the bottles also pours out into the apparatus. Any spilled fluid can be removed only after all of the stored bottles are taken out of the apparatus in a tedious manner.

Other collecting devices, which include transport and conveyor mechanisms by means of chains and sleds, do not solve the problems of a proper and economical storage of empty bottles any better than the already described devices.

OBJECTS AND SUMMARY OF THE INVENTION

It is, therefore, a principal object of the invention to provide an apparatus which deposits empty bottles in an orderly and regular manner in a container after checking them for proper size, while avoiding any danger of breakage by impinging on other bottles or hard surfaces. Furthermore, the apparatus provides that any remaining fluid in the bottles will not emerge therefrom because the bottles are stacked in the horizontal plane. Any remaining fluid which, nevertheless, flows out of a bottle can be removed without emptying the entire bottle container.

These and other objects are attained according to the invention by providing a container within the apparatus whose bottom has an opening substantially corresponding to the size of a bottle. The apparatus according to the invention further provides an externally powered and electrically controlled conveyor mechanism for inserting the bottles, one by one, through this opening into the interior of the container.

The invention will be better understood as well as further objects and advantages thereof become more apparent from the ensuing detailed description of an exemplary embodiment taken in conjunction with the drawing.

DESCRIPTION OF THE PREFERRED EMBODIMENT

Figure 1:
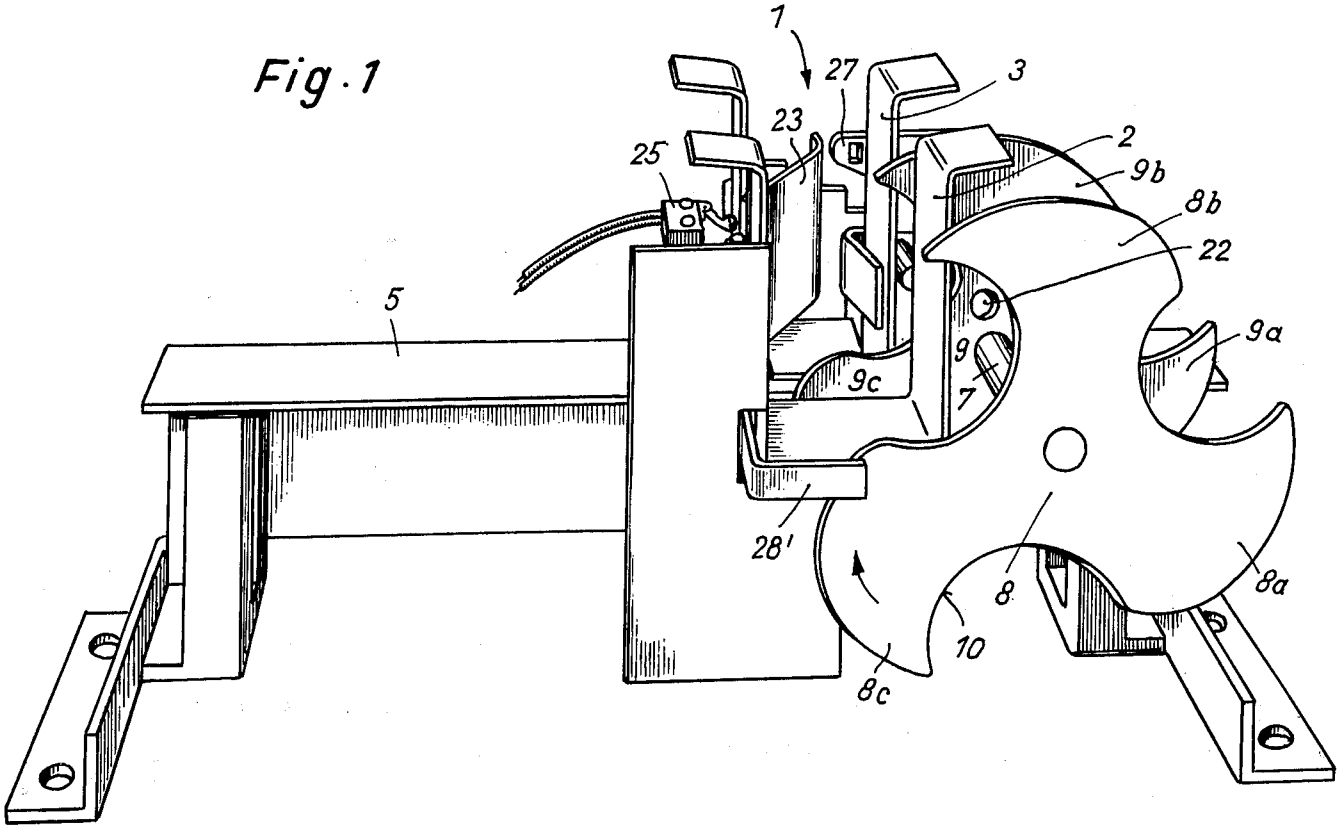
FIG. 1 is a perspective view of the conveyor mechanism within the bottle storing apparatus according to the invention.
Figure 2:
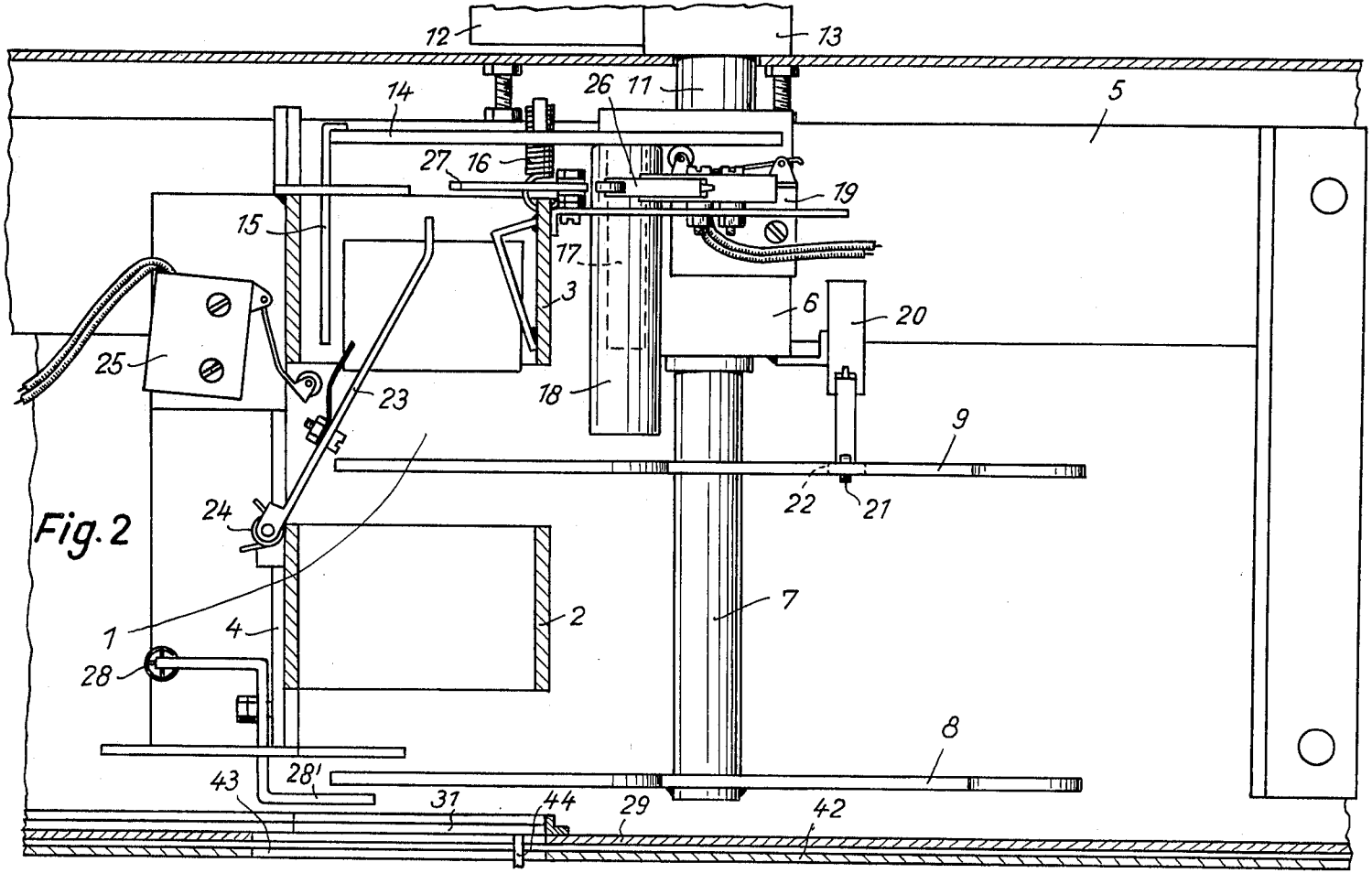
FIG. 2 is a top view of the conveyor mechanism including a partial view of the front and rear walls of the bottle container.
Figure 3:
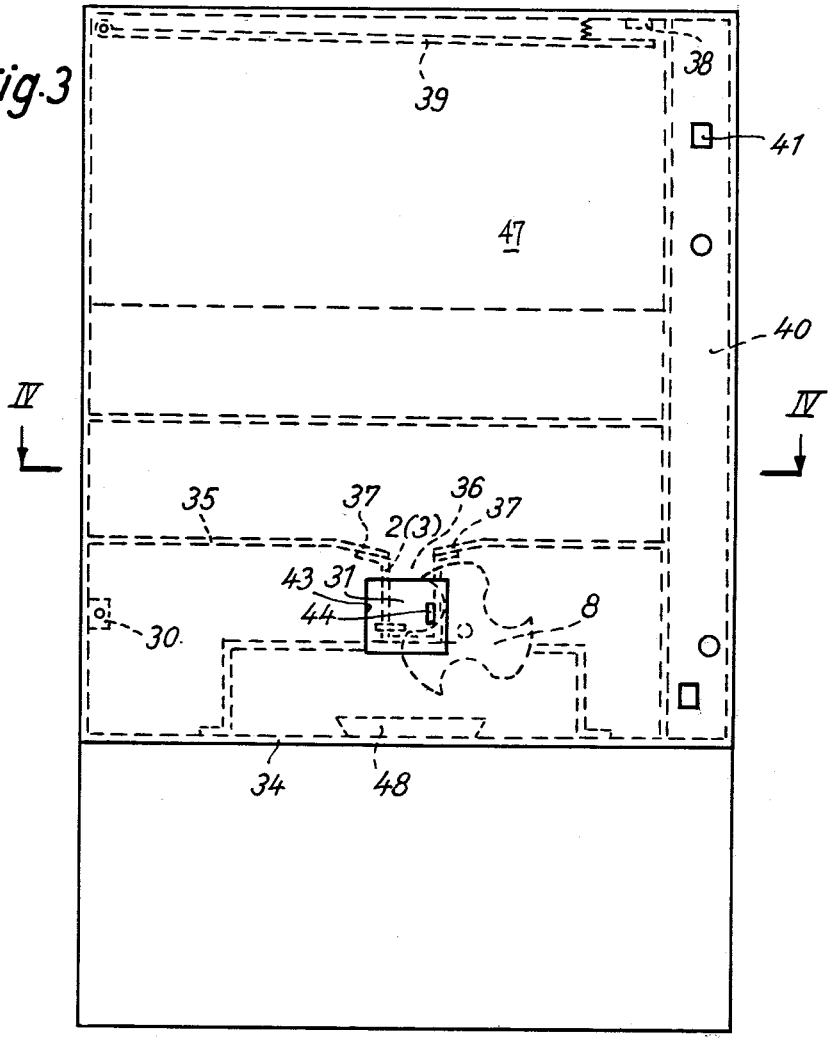
FIG. 3 is a front view of the housing of the apparatus.
Figure 4:
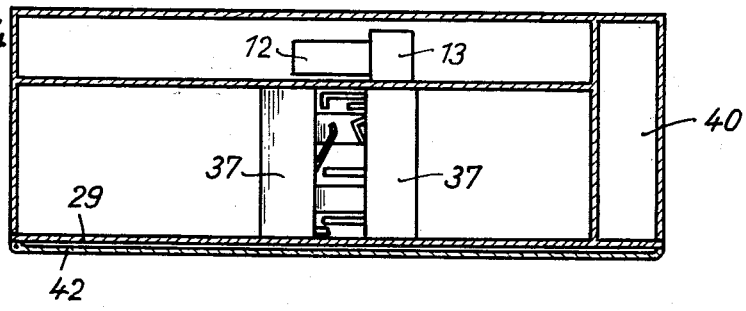
FIG. 4 is a section through the line IV—IV in FIG. 3.

Turning now to FIG. 1, there is shown a bottle receiver 1 formed substantially by two U-shaped brackets 2 and 3 which are mounted in a frame 5 and maintained at a fixed, parallel, mutual separation by an angle iron 4. Mounted on the frame 5 is a bearing housing 6 holding a rotating shaft 7. Mounted on the shaft 7 are two conveyor discs 8 and 9 whose extensions are designated by 8*a*, 8*b*, 8*c* and 9*a*, 9*b*, 9*c*, respectively. The openings 10 between the extensions are substantially semi-circular and have a diameter which corresponds to that of the bottles to be received therein with some clearance.

The end 11 of the shaft 7 remote from the discs 8 and 9 extends from the bearing housing 6 and is connected to a transmission 13 driven by a motor 12. The conveyor discs 8 and 9 and their extensions 8*a*, 8*b*, 8*c* and 9*a*, 9*b*, 9*c* protrude into the space between the brackets 2 and 3 and the space in front of the bracket 2, respectively, in the bottle receiver chamber 1. The recesses 10 in the discs 8 and 9 are aligned with one another.

The bottle receiver chamber 1 is defined at one end by a face plate 14 which has a vertical guide rail 15. The face plate 14 is capable of yielding inwardly against the force of a spring 16 and its motions are guided by a bolt 17 vertically affixed to the face plate and gliding in a bushing 18 mounted on the bearing housing 6. The motions of the face plate trigger a switch 19 mounted on the bearing housing.

The bearing housing 6 also carries a second switch 20 whose sensing roller 21 which can engage holes 22 in the disc 9.

A plate member 23 is mounted pivotably about a vertical axis and moves in the space between the brackets 2 and 3. It is pivotable outwardly against the force of the spring 24 and moves a switch 25 during its pivotal motion. A further switch 26 mounted on the bearing housing 6 controls a per se known device (not shown) for returning the bottle deposit. This switch is actuated by a small pivoting lever 27.

Attached near the entrance to the bottle chamber 1 is a bracket 28' which can pivot downwardly against the force of the spring 28 and which, in its normal position, prevents the backward sliding of a bottle once deposited in the chamber 1, but yields downwardly to a bottle which is being inserted in the chamber 1.

The bottle chamber 1 and the entire conveyor mechanism already described are closed off by a door 29 whose opening opens a switch 30 controlling the electric drive motor.

Disposed within the main door 29 is a small sliding door 31, located substantially in front of the bottle opening in the bottle chamber 1, through which empty bottles to be returned to the apparatus can be inserted. When the sliding door 31 is closed, a lock bolt 32 prevents its further opening until released by a solenoid 33. When the sliding door is open, it actuates a switch 45 which controls the drive motor 12.

The bottle conveyor mechanism is fastened on an intermediate shelf 34 of a cabinet while the brackets 2 and 3 extend upwardly up to the bottom of a bottle container 35 which has an opening 36. The parts of the container bottom 35 extending sideways from the opening are inclined surfaces 37.

The top of the bottle container is provided with a switch 38 which can interrupt the power supply to the drive motor via a rail 39 and will do so when the bottle container is completely filled up. This event is indicated by a signal lamp 41.

Disposed within a chamber adjacent the bottle container is a per se known coin return mechanism for returning the bottle deposit (not shown). A door 42 in the cabinet covers the entire front of the bottle container but has an opening 43 through which the bottles are inserted and through which extends a lever 44 for actuating the sliding door 31.

Figure 5:
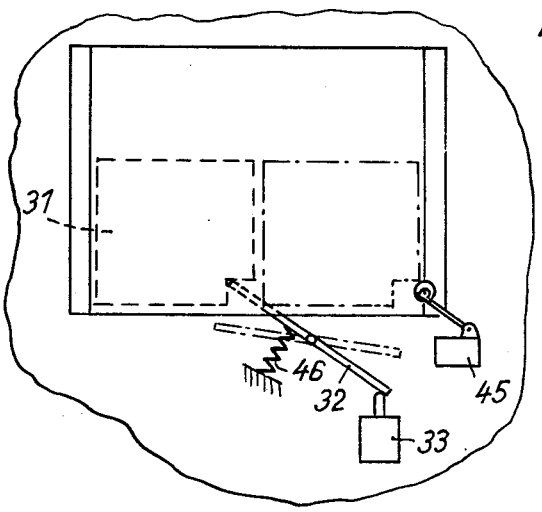
FIG. 5 illustrates the sliding door and the safety and switching elements for receiving bottles.
Figure 6:
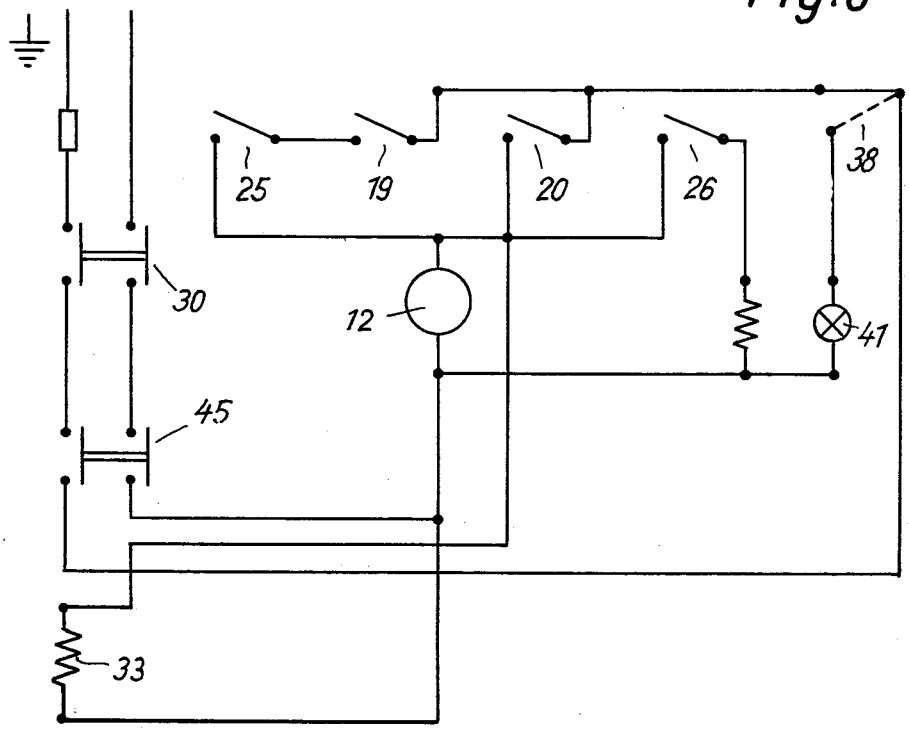
FIG. 6 is an electric circuit diagram for the apparatus according to the invention.

Normally, the switch 30 which actuates the electric drive motor is closed, since the door 29 is also closed. Similarly, the switch 45 is closed when the sliding door 31 is closed. On the other hand, the switches 25, 19, 20 and 26 each separately interrupt the motor power supply. A tension spring 46 holds the locking bolt 32 out of engagement as shown in dash-dot lines in FIG. 5.

When a customer slides the sliding door 31 to the right in the figure, he creates an access to the bottle chamber 1. This action opens the switch 45 and, hence, the drive motor circuit. Thus, it is safe to insert an empty bottle into the bottle chamber 1 and the inward motion of the bottle pushes the face plate 14 to the rear against the force of the spring 16, provided that it is long enough. This event closes the switch 19, whose purpose is the testing of the proper length of the bottle.

Similarly, if the bottle has a required minimum diameter, it actuates the switch 25 by pushing the plate 23 outwardly. At this time, the bottle will be enveloped loosely by the edge of the opening 10 in the discs 8 and 9.

When the sliding door 31 is now closed, switch 45 also closes and no longer interrupts the drive motor circuit. At the same time, the solenoid 33 is energized and locks the sliding door 31 against the force of the tension spring 46. The motor starts and the discs begin to turn so that the sensing roller 21 glides out of the hole 22, thereby closing the switch 20. The discs 8 and 9 turn in the clockwise sense and thus transport the bottle in the bottle chamber 1 and push it upwardly while the bottle rolls off the disc on the next disc extension. Shortly thereafter, the length and diameter switches 19 and 25, respectively, reopen.

Current to the motor is now supplied through the closed switch 20; the bottle is pushed along the brackets 2 and 3 and moves upwardly through the opening 36 into a container space 47. After the discs 8 and 9 have rotated the appropriate amount, the sensing roller 21 engages the next hole 22 in the disc 9, thereby again interrupting the electric circuit and arresting the entire mechanism until the next bottle is inserted into the bottle chamber, thereby repeating the above described process. When a new bottle is inserted and conveyed upwardly, it displaces the previously inserted bottle sideways and this motion is facilitated by the inclined planes 37. When a bottle moves upwardly, it also actuates the switch 26, which triggers the return of the bottle deposit. The various bottles arrange themselves adjacent and parallel to one another and form parallel layers.

This stacking scheme is very space-saving and there is no danger of bottle breakage because the bottles move and make contact slowly and do not undergo free-fall at any time.

When the bottle storage volume 47 is completely filled up, the topmost bottle or bottles engage the rail 39, which actuates the switch 38 and thereby interrupts the power to the motor. At the same time, it energizes the signal lamp 41 which indicates that the apparatus can receive no further bottles.

Inasmuch as the front of the bottle container can be flipped partially downwardly, the bottles stored in the container 47 may be removed easily after opening the cabinet door 42.

If, in exceptional cases, remaining fluid in one or the other bottles were to flow into the storage space 47, it would flow through the opening 36 into a collector pan 48 which can be emptied at any time without necessitating the removal of the bottles from the storage space 47.

The above described apparatus for receiving empty bottles is distinguished by simple manipulation and is safe for the user due to the multiple securing of the operation by test and control switches.

What is claimed is:

1. An apparatus for storing cylindrical objects, especially empty bottles, comprising:

a cabinet having a bottle chamber;

a bottle storage container disposed in said cabinet and further comprising a base including an aperture; a bracket means aligned with said aperture in said cabinet, switch means in proximity to said bracket means arranged to be actuated upon insertion of an empty bottle into said cabinet;

bottle conveyor means disposed adjacent to and below said bottle storage container further including at least one rotatably disposed conveyor disc which extends into said bottle chamber for transporting individual bottles after insertion through said aperture upwardly into said bottle storage container.

2. An apparatus as defined by claim 1, wherein said at least one conveyor means is a plurality of rotatably disposed conveyor discs, mounted on a common, drivable shaft.

3. An apparatus as defined by claim 2, wherein each of said conveyor discs has at least one substantially semi-circular recess in its circumference, the size of said recess being substantially adapted to the form of the bottles to be properly received by said apparatus.

4. An apparatus as defined by claim 3 in which said recess in one of said conveyor discs is substantially aligned axially with the recess in another of said conveyor discs.

5. An apparatus as defined by claim 4, wherein at least one of said conveyor discs includes a surface discontinuity and the conveyor means includes power drive means and first switch means which engages said surface discontinuity, thereby controlling said drive means.

6. An apparatus as defined by claim 5, said apparatus further comprising resilient plate means for defining one wall of said bottle chamber.

7. An apparatus as defined by claim 6, further comprising second switch means, for controlling the electric circuit of said drive means, actuated by said resilient plate means, thereby testing the length of a bottle inserted in said bottle chamber.

8. An apparatus as defined by claim 7, further comprising baffle means, pivotably mounted in said bottle chamber and urged by spring means against an inserted bottle, and third switch means associated with said baffle means, for testing the lateral dimension of a bottle inserted in said bottle chamber.

9. An apparatus as defined by claim 8, further comprising lever means, pivotably attached to said conveyor means and protruding under spring tension into said bottle chamber, for holding the bottom of a bottle.

10. An apparatus as defined by claim 9, further comprising fourth switch means, actuated by a bottle inserted into said apparatus, for enabling the operation of associated coin return means.

11. An apparatus as defined by claim 10, further comprising a door in said bottle container and fifth switch means associated therewith for controlling said drive means when said door is opened and closed.

12. An apparatus as defined by claim 11, wherein said door includes slide means defining a variable opening in said door and sixth switch means associated therewith for controlling said drive means when said slide means is opened and closed.

13. An apparatus as defined by claim 12, further comprising solenoid-actuated bolt means for locking said slide means in the closed position.

14. An apparatus as defined by claim 13, further comprising seventh switch means, associated with said bottle container, for actuation by bottles stored in said container and for controlling said drive means.

* * * * *